US007742732B2

(12) United States Patent
Amico et al.

(10) Patent No.: US 7,742,732 B2
(45) Date of Patent: Jun. 22, 2010

(54) FUSER ARRANGED FOR REDUCED PRESSURE MEMBER SPEED, AND AN IMAGE FORMING DEVICE INCLUDING THE SAME

(75) Inventors: Mark S Amico, Pittsford, NY (US); Martin F Zess, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 315 days.

(21) Appl. No.: 11/862,455

(22) Filed: Sep. 27, 2007

(65) Prior Publication Data

US 2008/0013991 A1 Jan. 17, 2008

Related U.S. Application Data

(63) Continuation-in-part of application No. 11/298,242, filed on Dec. 9, 2005, now Pat. No. 7,280,793.

(51) Int. Cl.
*G03G 15/20* (2006.01)

(52) U.S. Cl. ..... 399/328; 399/68

(58) Field of Classification Search ..... 219/216; 399/68, 322, 323, 328, 329
See application file for complete search history.

(56) References Cited

U.S. PATENT DOCUMENTS

| | | | | |
|---|---|---|---|---|
| 3,716,221 | A | 2/1973 | Gorka et al. | |
| 3,934,113 | A | 1/1976 | Bar-on | |
| 4,042,804 | A | 8/1977 | Moser | |
| 5,268,559 | A | 12/1993 | Jacobs | |
| 5,359,401 | A * | 10/1994 | Uehara et al. | 399/67 |
| 5,623,720 | A | 4/1997 | Howe et al. | |
| 5,697,036 | A | 12/1997 | Moser | |
| 5,822,668 | A | 10/1998 | Fromm et al. | |
| 5,873,020 | A | 2/1999 | Matsuura et al. | |
| 6,490,428 | B1 | 12/2002 | Fromm et al. | |
| 6,782,228 | B1 | 8/2004 | Rasch et al. | |
| 6,782,233 | B2 | 8/2004 | Condello et al. | |
| 6,785,503 | B2 | 8/2004 | Kuo et al. | |
| 6,963,717 | B1 | 11/2005 | Klimley et al. | |
| 2003/0039491 | A1 | 2/2003 | Bogoshian | |
| 2005/0156377 | A1 | 7/2005 | Jacobs | |

* cited by examiner

*Primary Examiner*—Hoang Ngo
(74) *Attorney, Agent, or Firm*—Gibb I.P. Law Firm, LLC

(57) ABSTRACT

A fuser assembly comprises a fusing member and a pressure member, where the fusing member and the pressure member cooperatively rotate to form a fuser nip. The fuser is arranged so that the pressure member speed is reduced with respect to the fusing member speed, thus forming a reduced pressure member speed. The reduced pressure member speed stretches or retards the surface of the fusing member elastomer enough to assist in stripping or peeling the media sheet lead edge from the fusing member. As a result of initially stripping or peeling the media sheet lead edge, the remaining media body likewise is assisted to be stripped or peeled from the fusing member. In various embodiments the media stripping or peeling process is assisted by means of one or more air knives, one or more stripping fingers, or any combination of these items.

17 Claims, 4 Drawing Sheets

FUSER ARRANGED FOR REDUCED PRESSURE MEMBER SPEED, AND AN IMAGE FORMING DEVICE INCLUDING THE SAME

CROSS-REFERENCE TO RELATED APPLICATIONS

This is a continuation-in-part of its commonly-assigned parent application Ser. No. 11/298,242 filed 9 Dec. 2005 by the same inventors hereof, now pending, and claims the priority benefit of the same application under the provisions of 35 U.S.C. section 120, the disclosure of which parent application in its entirety hereby is totally incorporated herein by reference.

INCORPORATION BY REFERENCE OF OTHER U.S. PATENT DOCUMENTS

The disclosures of the following fifteen (15) U.S. Patent Documents in their entirety hereby are totally incorporated herein by reference:

U.S. Pat. No. 6,963,717 B1, "Fuser stripper baffle and a printing machine including the same", issued 8 Nov. 2005 to William R. Klimley et al., assigned to Xerox Corporation;

U.S. Pat. No. 6,785,503 B2, "Stripper fingers and roller assembly for a fuser in a printing apparatus", issued 31 Aug. 2004 to Youti Kuo et al., assigned to Xerox Corporation;

U.S. Pat. No. 6,782,233 B2, "Externally heated thick belt fuser", issued 24 Aug. 2004 to Anthony S. Condello et al., assigned to Xerox Corporation;

U.S. Pat. No. 6,782,228 B1, "Intermittent stripper fingers and baffle for stripping copy media from a heated fuser roll", issued 24 Aug. 2004 to Kenneth R. Rasch et al., assigned to Xerox Corporation;

U.S. Pat. No. 6,490,428 B1, "Stripper fingers and associated mounts for a fuser in a printing apparatus", issued 3 Dec. 2002 to Paul M. Fromm et al., assigned to Xerox Corporation;

U.S. Pat. No. 5,873,020, "Fixing device with endless belt", issued 16 Feb. 1999 to Masahiko Matsuura et al.;

U.S. Pat. No. 5,822,668, "Fuser subsystem module for an electrophotographic printer which pivots open for jam clearance", issued 13 Oct. 1998 to Paul M. Fromm et al., assigned to Xerox Corporation;

U.S. Pat. No. 5,697,036, "Single roll RAM system", issued 9 Dec. 1997 to Rabin Moser, assigned to Xerox Corporation;

U.S. Pat. No. 5,623,720, "Method and apparatus for stripper bar rotation", issued 22 Apr. 1997 to Richard L. Howe et al., assigned to Xerox Corporation;

U.S. Pat. No. 5,268,559, "High speed pictorial color belt fuser with straining elastic belt", issued 7 Dec. 1993 to Robert M. Jacobs, assigned to Xerox Corporation;

U.S. Pat. No. 4,042,804, "Roll fuser apparatus", issued 16 Aug. 1977 to Rabin Moser, assigned to Xerox Corporation;

U.S. Pat. No. 3,934,113, "Roll fuser apparatus and mounting arrangement therefor", issued 20 Jan. 1976 to Ari Bar-on, assigned to Xerox Corporation;

U.S. Pat. No. 3,716,221, "Fusing device", issued 13 Feb. 1973 to Donald J. Gorka et al.;

U.S. Patent Application Publication No. US 2005/0156377 A1, "Fuser sheet stripping system", published 21 Jul. 2005 by Robert M. Jacobs; and U.S. Patent Application Publication No. US 2003/0039491 A1, "Multi-function air knife", published 27 Feb. 2003 by Gregory V. Bogoshian.

BACKGROUND OF THE INVENTION

The present disclosure pertains to fusers and methods for stripping printed paper or media or media sheets from a fusing member.

As is known, in a typical electrophotographic copying or printing process, a charged photoconductor is exposed to form an electrostatic latent image. As described aforementioned U.S. Pat. No. 6,782,233 to Anthony S. Condello et al. ("Condello"), at col. 1, lines 12-41, this latent image is then developed by bringing a developer material such as toner in contact therewith. The toner is deposited as a latent electrostatic image on the photoconductor. The toner image is then transferred from the photoconductor to a copy substrate such as, for example, paper or media or another media. In order to fix or fuse the toner onto the media permanently by heat, the toner material is heated to cause the toner to flow onto the fibers or pores of the media. Thereafter, as the toner cools, the toner solidifies, thus causing the toner to permanently bond to the media.

Typical fusing arrangements are described in the foregoing Condello patent, especially from col. 1, line 42 to col. 4, line 9.

It is known to use one or more stripper fingers to separate, sever or "strip" a printed paper or media or media sheet from a heated fusing member. For example, the aforementioned U.S. Pat. No. 6,963,717 to William R. Klimley et al. depicts in FIG. 1 a fuser stripper baffle 20 comprising individual stripper baffle fingers 10.1 through 10.7 arranged to strip a paper or media or media sheet 30 from a fuser roll 10. The stripping process is depicted in FIG. 3.

Further, the aforementioned U.S. Pat. No. 6,785,503 to Youti Kuo et al. depicts in FIG. 4 a set of stripper fingers 30 arranged to lift a printed sheet off a fuser roll 10 near the fuser nip 14 as the sheet passes therethrough.

Further, the aforementioned U.S. Pat. No. 6,782,228 to Kenneth R. Rasch et al. depicts in FIGS. 13 and 14 a plurality of stripper finger assemblies 40 arranged to strip printed paper or media or media sheets from the heated fuser roll 12. As described at col. 5, lines 46-56, each stripper finger assembly comprises a base member 42 fabricated from a suitable plastic or metal material. A leaf spring 44 is mounted at one end on the base member 42 and has affixed to its free end a plastic tip 46 that always contacts the heated fuser roll.

Further, the aforementioned U.S. Pat. No. 6,490,428 B1, "Stripper fingers and associated mounts for a fuser in a printing apparatus", issued 3 Dec. 2002 to Paul M. Fromm et al. depicts in FIG. 5 a plurality of stripper fingers 30 arranged to strip a printed sheet from a fuser apparatus comprising a fuser roll 10 and a pressure roll 12.

Further, the aforementioned U.S. Pat. No. 5,822,668, "Fuser subsystem module for an electrophotographic printer which pivots open for jam clearance", issued 13 Oct. 1998 to Paul M. Fromm et al. depicts in FIG. 1 one or more stripper fingers 16 disposed across a longitude of fuser roll 12 and arranged to strip printed sheets from the surface of fuser roll 12.

Further, the aforementioned U.S. Pat. No. 5,623,720 to Richard L. Howe et al. depicts in FIG. 4 one or more stripper fingers 104 spring-biased towards a heated fuser roller 54 and arranged to strip printed sheets from the surface of fuser roll 54.

Further, the aforementioned U.S. Pat. No. 4,042,804 to Rabin Moser depicts in FIG. 1 one or more stripper fingers 68 which are arranged to ensure removal of the printed substrate 35 from the fuser assembly 15 as the substrate passes through the nip 34 that is created by the heated fuser roll 30 and the included cooperating pressure or backup roll 33.

Further, the aforementioned U.S. Pat. No. 3,934,113 to Ari Bar-on depicts in FIGS. 4 and 8 a plurality of L-shaped stripper fingers 134 arranged to strip a printed sheet 14 from a fuser assembly 15 comprising a heated fuser roll 30 and a corresponding pressure or backup roll 32 which cooperate to form a nip 33. An alternate form of stripper finger may be employed comprising the stripper fingers 142 as depicted in FIG. 9. See also Bar-on's written description from col. 7, line 32 to col. 8, line 6.

It is also known to use one or more air knives to strip a printed paper or media or media sheet from a fusing member. For example, the aforementioned U.S. Patent Application Publication No. 2005/0156377 by Robert M. Jacobs ("Jacobs") depicts in FIG. 3 a stripper finger 26 that includes an internal pneumatic conduit or air channel 27 therein extending from a flexible hose or other pneumatic connection to conventional or existing machine blower 30. As described in paragraph 0018, this internal conduit or air channel 27 extends all the way out to closely to the stripping edge 27, where this air channel 27 has an upwardly directed opening 28, for blowing air under the leading edge 14 of the printed sheet 12 up away from the fuser roll 24 and towards the normal downstream sheet path in cooperation with the stripper finger 26 stripping edge 27 catching and lifting of that same sheet leading edge 14, thereby effectively increasing the radius of the sheet 12 leading edge 14 in the stripping area which would be created by the mechanical stripper finger 26, thereby reducing the chance of the sheet 12 lead edge folding up and jamming at that location, rather than stripping off into the downstream sheet path, as shown by dot-dashed lines and motion arrows in FIGS. 2 and 3 of Jacobs.

Further, the aforementioned U.S. Patent Application Publication No. 2003/0039491 by Gregory V. Bogoshian ("Bogoshian") depicts in FIGS. 5 and 6 a corrugating air knife 400. As described in paragraph 0032, the corrugating air knife 400 comprises a manifold 401 that directs a stream of air across the width of the printed sheet 52 as the sheet exits the fuser arrangement comprising the heated fusing roll 62 and the included cooperating pressure roll 64. The air knife 400 includes extra ribs 402 formed which have an air passage integral to the rib 402, as shown in FIG. 5. The localized stream of air flowing from the ribs 402 causes a lightweight paper or media or media sheet to corrugate due to the air stream that increases the beam strength of the sheet and prevents the lead edge of the sheet 152 from folding over and wrapping around the fusing roll 62.

Further, the aforementioned U.S. Pat. No. 3,716,221 to Donald J. Gorka et al. ("Gorka") depicts in FIGS. 1 and 4 an air knife 87 and a stripping and guide blade 88 arranged to strip a printed sheet from the nip area formed between the fusing roller 10 and the cooperating pressure or backup roller 12. See also Gorka's written description at col. 6, lines 31-59.

Currently, paper or media or media sheets processed through xerographic printing machines have a tendency to stick to the fusing roll as excessive toner builds up onto the fusing roll. In order to counteract this problem, an air knife is used to help strip the lead edge from the fuser roll. If the lead edge has a problem stripping from the roll then the air knife baffle is supposed to help strip the paper or media from the fuser roll. Notwithstanding these stripping actions, further stripping improvements are still possible.

Thus, there is a need for the present invention.

BRIEF SUMMARY OF THE INVENTION

In a first aspect of the invention, there is provided a fuser comprising a fusing member and a pressure member, where the fusing member and the pressure member cooperatively rotate to form a fuser nip, the fuser being arranged so that when an included media sheet exits the fuser nip the pressure member speed is reduced with respect to the fusing member speed, thus forming a reduced pressure member speed.

In a second aspect of the invention, there is provided a fuser comprising a fusing member and a pressure member, where the fusing member and the pressure member cooperatively rotate to form a fuser nip, the fuser being arranged so the pressure member speed is reduced with respect to the fusing member speed, thus forming a reduced pressure member speed.

In a third aspect of the invention, there is provided an image forming device including a fuser, the fuser comprising a fusing member and a pressure member, where the fusing member and the pressure member cooperatively rotate to form a fuser nip, the fuser being arranged so the pressure member speed is reduced with respect to the fusing member speed, thus forming a reduced pressure member speed.

BRIEF DESCRIPTION OF THE SEVERAL VIEWS OF THE DRAWING

In FIG. 2 the fusing member comprises the fusing roller 10 and the pressure member comprises the pressure roller 20 as shown. The fuser 100 further comprises a pressure member braking means 60. Also shown in FIG. 2 are two (2) optional elements respectively numbered 50 and 70. Reference number 50 depicts an optional sensor comprising one or more optical sensing devices, one or more mechanical sensing devices, or any combination of these items. Reference number 70 depicts an optional stripping assisting arrangement comprising any of one or more air knives, one or more stripping fingers, or any combination of the foregoing items.

In FIG. 3 the fuser member comprises the fusing roller 10 arranged with a fusing belt 90 as shown. In one embodiment the arrangement of the fusing roller 10 and the fusing belt 90 as depicted in FIG. 3 is similar to the belt fusing arrangement 10 as described in the aforementioned U.S. Pat. No. 6,782,233 B2 to Anthony S. Condello et al. Also in FIG. 3 the pressure member comprises the pressure roller 20 arranged with a pressure belt 80 as shown. FIG. 3 also depicts the two (2) optional elements respectively numbered 50 and 70 that are described above in connection with FIG. 2.

DETAILED DESCRIPTION OF THE INVENTION

Briefly, a fuser assembly comprises a fusing member and a pressure member, where the fusing member and the pressure member cooperatively rotate to form a fuser nip therebetween. The fuser is arranged so that the pressure member speed is reduced with respect to the fusing member speed, thus forming a reduced pressure member speed. The reduced pressure member speed stretches or retards the surface of the fusing member elastomer enough to assist in stripping or peeling the media sheet lead edge from the fusing member. As a result of initially stripping or peeling the media sheet lead edge, the remaining media body likewise is assisted to be stripped or peeled from the fusing member. In various embodiments the media stripping or peeling process is assisted by means of one or more air knives, one or more stripping fingers, or any combination of these items.

Figure 1:
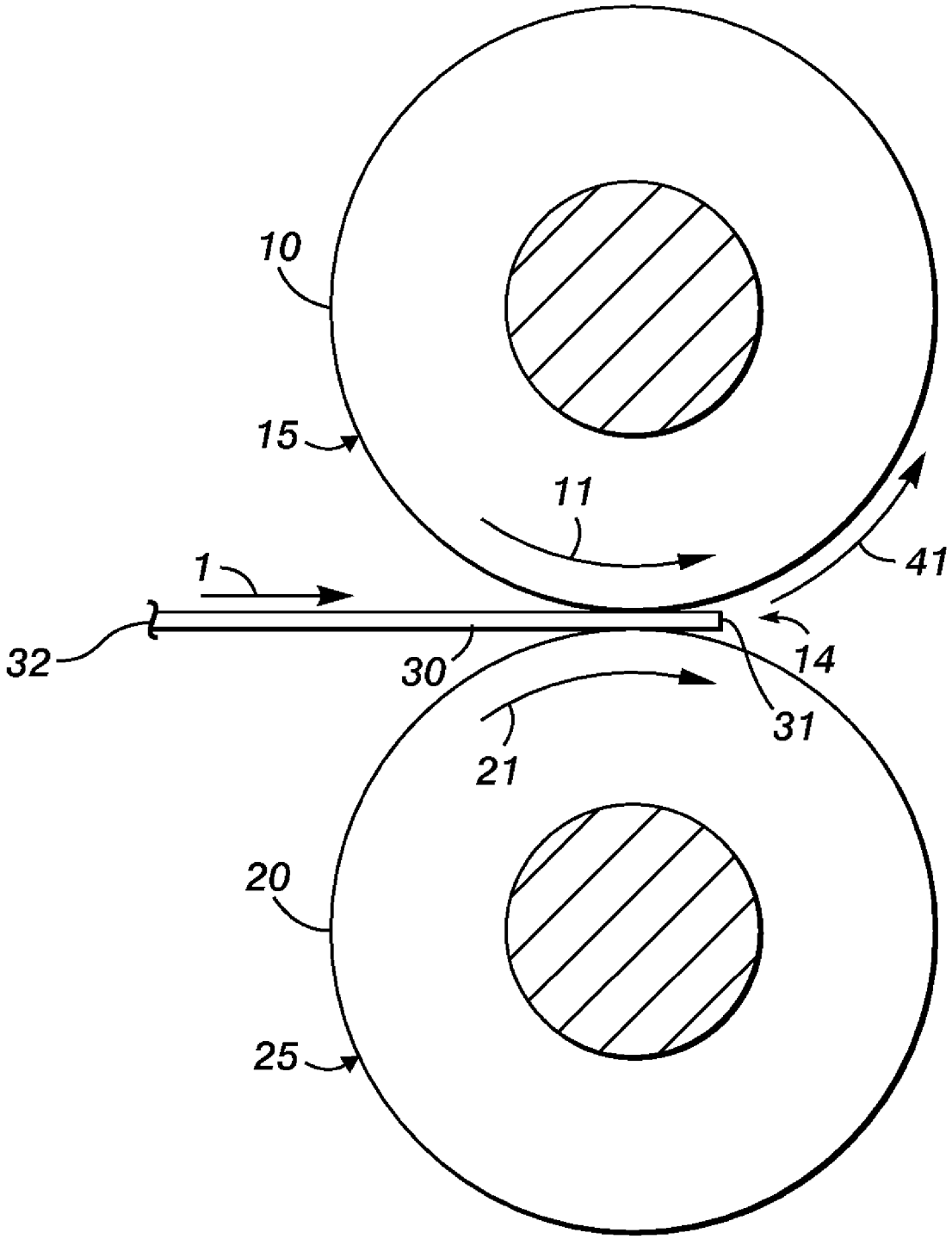
FIG. 1 PRIOR ART
FIG. 1 is a cutaway profile attached view of a fuser comprising a fusing member 10 and a pressure member 20. As shown, the fusing member or fusing roller 10 and the pressure member or pressure roller 20 cooperate to form a fuser nip 14 therebetween. A printed paper or media or media sheet 30 travels through the fuser nip 14 in a downstream or process direction depicted by the arrow 1.

Referring now to FIG. 1, there is shown a cutaway profile attached view of a current fuser arrangement comprising a heated fusing member 10 and a pressure member 20. A printed paper or media or media sheet 30 is depicted as moving or traveling in a downstream or process direction depicted by the arrow 1.

As shown, the fusing member 10 contacts the pressure member 20 along a longitude thereof, the fusing member 10 and the pressure member 20 cooperating to form a fuser nip 14 therebetween. As is familiar in the art, the printed sheet 30, such as created by xerographic printing, is pulled through the nip by the angular motion 11 of the fusing member 10 and the cooperating angular motion 21 of the pressure member 20.

Typically the freshly-fused marking material, such as toner, on the print sheet, which is facing up in the view of FIG. 1, may cause the sheet to stick to the surface of fusing member 10 even after passing through fuser nip 14, such paper or media or media sheet 30 fusing member 10 surface sticking or adhering being depicted in FIG. 1 by reference number 41. In FIG. 1 the fusing member 10 outer periphery 15 moves at a surface speed of "X" and the pressure member 20 outer periphery 25 moves at a surface speed of "Z".

Figure 2:
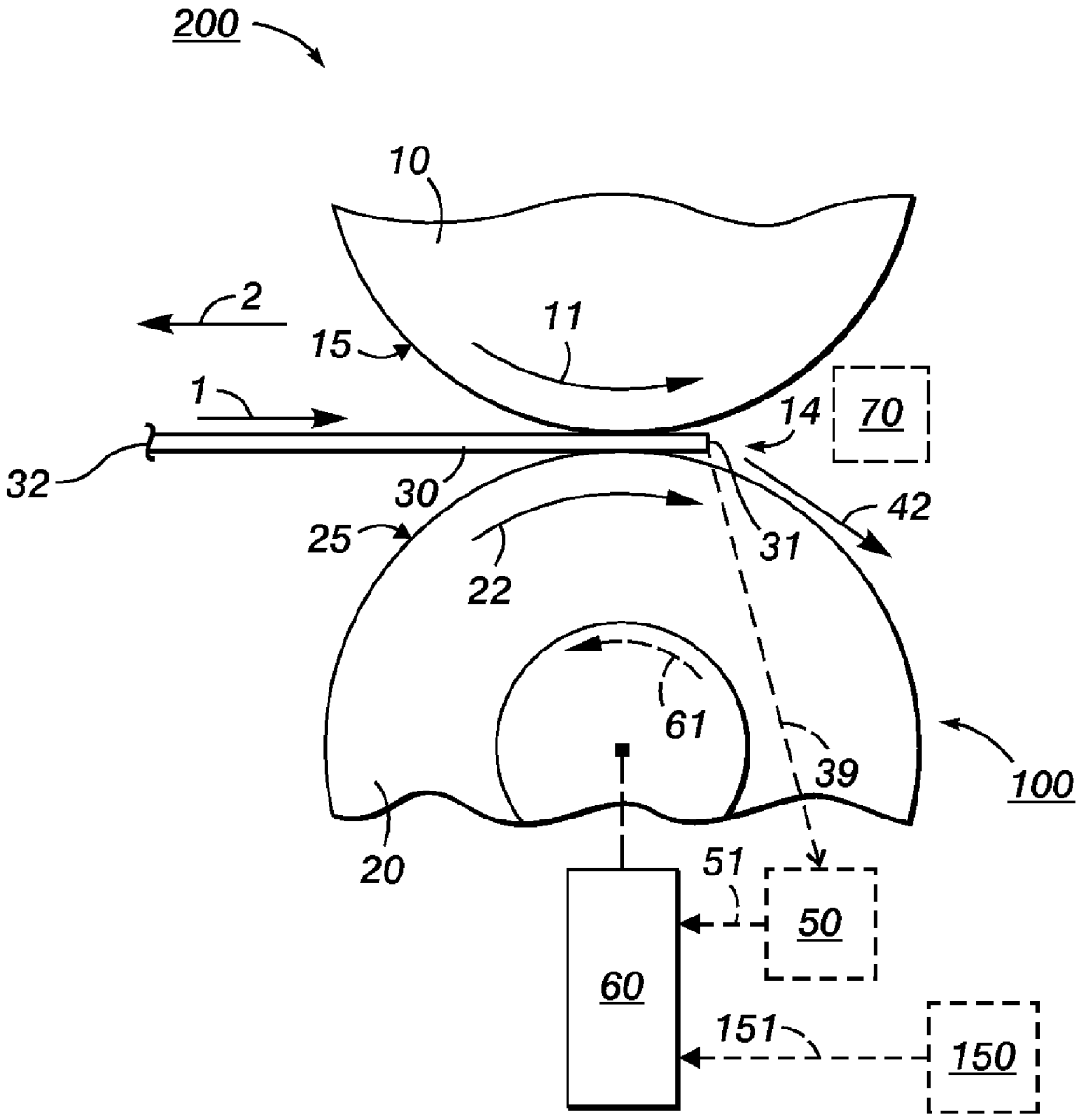
FIG. 2 is a cutaway profile attached view of an image forming device 200. In turn, the image forming device 200 includes a first embodiment of a fuser arranged for reduced pressure member speed 100, in accordance with the present invention. As shown, the fuser 100 comprises a fusing member 10 and a pressure member 20.

Referring now to FIG. 2, there is shown an image forming device 200 including a first embodiment of a fuser arranged for reduced pressure member speed 100. The FIG. 2 fuser 100 comprises a roller fusing member comprising the roller 10 as shown. Also, the FIG. 2 fuser 100 comprises a roller pressure member comprising the roller 20 as shown. The fuser 100 also includes the pressure member braking means 60 arranged as shown. Further, in various optional embodiments the fuser 100 also includes the optional sensor 50 arranged as shown.

Figure 3:
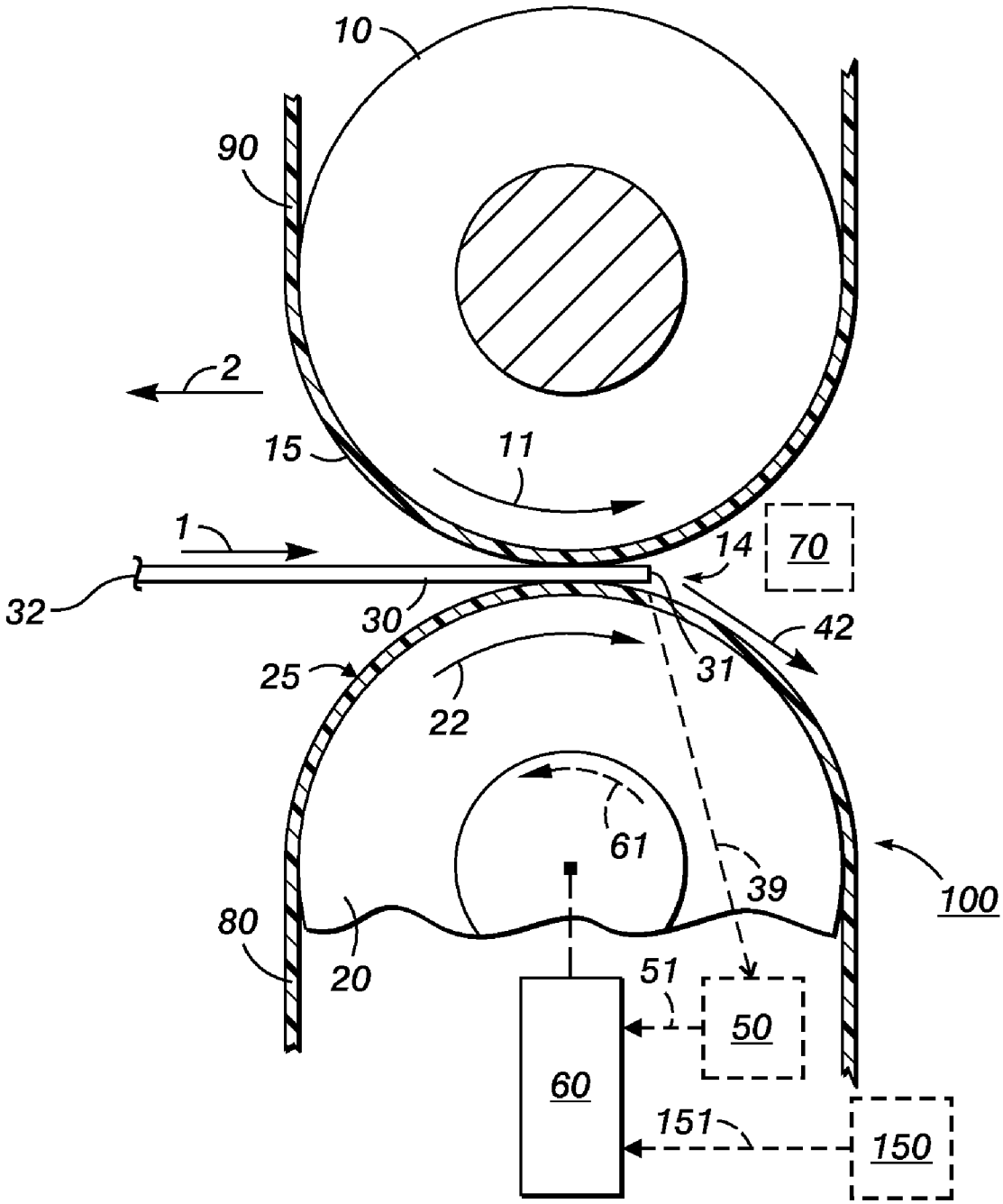
FIG. 3 is a cutaway profile attached view of a second embodiment of a fuser arranged for reduced pressure member speed 100, in accordance with the present invention. As shown, the fuser 100 comprises a fusing member and a pressure member.

Referring now to FIG. 3, there is shown a second embodiment of the fuser 100. As described above, the FIG. 3 fuser comprises a belt fusing member comprising the roller 10 and the belt 90 as shown. Also, the FIG. 3 fuser uses a belt pressure member comprising the roller 20 and the belt 80 as shown.

Referring generally to FIGS. 2-3, various embodiments of the fuser arranged for reduced pressure member speed 100 now are described.

In various embodiments, when the paper or media or media sheet leading edge 31 exits the fuser nip 14, this leading edge 31 exiting nip event 39 is indicated by the optional sensor 50. Based on detecting the leading edge 31 fuser nip 14 exiting event 39, the optional sensor 50 provides a sensor output signal 51 to the pressure member braking means 60. Based on receiving this optional sensor output signal 51, the pressure member braking means 60 provides, applies, causes or initiates a pressure member braking action or force 61 with respect to the pressure member's depicted angular motion 21.

Based on the pressure member braking action 61, the pressure member's angular motion or speed 21 is thereby diminished, reduced, decreased, retarded, lessened or slowed, thus forming a reduced pressure member speed 22.

Based on the reduced pressure member speed 22, the surface of the fusing member's elastomer is caused to stretch or retard enough to assist in peeling the lead edge 31 from the fusing member, thereby allowing the rest of the paper or media or media sheet 30 to peel-off, sever or separate from the surface of the fusing member.

Thus, in FIG. 2 the resulting paper or media or media sheet 30's peeling-off, severing or separating from the fusing member's roller 10 surface is depicted by reference number 42.

Further, in FIG. 3 the resulting paper or media or media sheet 30's peeling-off, severing or separating from the fusing member's belt 90 surface likewise is depicted by reference number 42.

In various embodiments the pressure member braking means 60 is arranged to provide a pressure member braking action 61 which, in turn, diminishes, reduces, decreases, retards, lessens or slows the pressure member's angular motion or speed 21 when the paper or media sheet lead edge 31 exits 39 the fuser nip 14. The resulting reduced pressure member speed 22 stretches or retards the surface of the fusing roller 10 in FIG. 2 or fusing belt 90 in FIG. 3 elastomer enough to assist in peeling the lead edge 31 from the fusing roller 10 in FIG. 2 or fusing belt 90 in FIG. 3 thereby allowing the rest of the paper or media or media sheet 30 to peel-off the surface of the fusing roller 10 in FIG. 2 or fusing belt 90 in FIG. 3, such paper or media or media sheet 30 peeling-off or severing being depicted in FIGS. 2-3 by reference number 42. In one embodiment, the paper or media or media sheet peeling process 42 is assisted by means of an included optional arrangement 70 comprising any of one or more air knives, one or more stripping fingers, or any combination of the foregoing items.

Still referring to FIGS. 2-3, as a result of the pressure member angular speed 21 pressure member braking action 61 provided by the braking means 60, the fusing roller 10's outer periphery 15 in FIG. 2 or fusing belt 90 in FIG. 3 remains at a surface speed of X whereas, in contrast, the pressure roller 20's outer periphery 25 in FIG. 2 or pressure belt 80 in FIG. 3 now moves at a reduced surface speed, Z', which equals $Z-(Y\% \times Z)$, where Y is the percent desired speed difference and Z is the unconstrained pressure roller rotational speed. Hence, as the pressure roller 20's angular motion speed 21 in FIG. 2 or the pressure belt 80's speed in FIG. 3 is less than the unconstrained pressure roller 20's angular motion speed in FIG. 2 or the unconstrained pressure belt 80's speed in FIG. 3, there is provided to the printed paper or media or media sheet 30 a force that assists the printed paper or media or media sheet 30 leading edge 31 to peel-off, separate, sever or strip from the surface of the fusing roller 10 in FIG. 2 or the fusing belt 90 in FIG. 3, such peeling-off, separating, severing or stripping from the surface of the fusing member 10 being depicted in FIGS. 2-3 by reference number 42.

As above, in various embodiments the pressure member braking action 61 is provided based on the paper or media leading edge 31 exiting 39 the fuser nip 14.

Referring still to FIGS. 2-3, in various embodiments the optional sensor 50 comprises an optical sensor arranged to indicate the paper or media or media leading edge 31 exiting the fuser nip 14. Using an optical sensor provides multiple advantages. One factor is the optical sensor's fast response time, critical for high-speed printers. A second factor is the optional sensor 50 does not damage the sheet being detected, as a mechanical sensor could. A third factor is the no de-bouncing which is a factor in mechanical switches.

In various embodiments, upon the optional sensor 50 detecting the leading edge 31 exiting 39 the fuser nip 14, the pressure member braking action 61 is initiated. The physical distance between the sheet's detection by the pre-fuser switch and the fusing nip entrance can be arbitrary. Therefore, the critical pressure member braking action 61 needs to occur as the media edge 31 exits 39 the fuser nip 14.

Referring again generally to FIGS. 2-3, now various further and supplemental embodiments of the fuser arranged for reduced pressure member speed 100 are described. With respect to the various further and supplemental embodiments that are described below, the optional sensor 50 is sometimes but not always provided. In other words, with respect to the various further and supplemental embodiments that are described below, in certain embodiments the optional sensor 50 is provided while in other embodiments the fuser 100 is devoid of the optional sensor 50.

Still referring to FIGS. 2-3, in various embodiments the fuser 100 comprises a fusing member 10 or 90 and a pressure member 20 or 80, where the fusing member and the pressure member cooperatively rotate to form a fuser nip 14, the fuser being arranged so that when an included media sheet 30 exits 39 the fuser nip 14 the pressure member speed 21 is reduced with respect to the fusing member speed 11, thus forming a reduced pressure member speed 22. The reduced pressure member speed 22 stretches or retards the surface of the fusing member 10 or 90 elastomer enough to assist in stripping or peeling the media sheet lead edge 31 from the fusing member 10 or 90. As a result of initially stripping or peeling the media sheet lead edge 31, the remaining media body 30 likewise is assisted to be stripped or peeled from the fusing member 10 or 90. In various embodiments the media stripping or peeling process is assisted by means of one or more air knives, one or more stripping fingers, or any combination of these items.

As described above, the reduced pressure member speed 22 is based on a pressure member braking action 61 provided by an included braking means 60.

In various embodiments, the pressure member braking action 61 is applied until the media leading edge 31 is stripped is stripped 42 from the surface of the fusing member 10 or 90.

In various embodiments, the pressure member braking action 61 is provided based on detecting the presence of a specifically difficult-to-strip media 30 in the fuser nip 14 by the depicted included detector 150. As a result, based on detecting that the specifically difficult-to-strip media 30 is present in the fuser nip 14, the detector 150 causes the braking means 60 to initiate the pressure member braking action 61 by means of the detector output signal 151.

In various embodiments, the pressure member braking action 61 is provided based on a predetermined event that occurs prior to and before the media sheet 30 enters the fuser nip 14.

In various embodiments, the pressure member braking action 61 is provided based on a predetermined event that occurs prior to and before the media sheet 30 enters the fuser nip 14 and further based on the passage, elapse or running of a predetermined time period.

In one variation, the predetermined event comprises a detecting of a feeding or dispensing of the media sheet 30 in the upstream media path 2 by the depicted included detector 150. As a result, based on detecting the media sheet 30 being fed or dispensed in the upstream media path 2, the detector 150 causes the braking means 60 to initiate at a predetermined time the pressure member braking action 61 by means of the detector output signal 151.

In a further variation, the predetermined event comprises a detecting of the presence of the media sheet 30 at a fixed point in the upstream media path by the depicted detector 150. As a result, based on detecting the presence of the media sheet 30 at the fixed point in the upstream media path 2, the detector 150 causes the braking means 60 to initiate at a predetermined time the pressure member braking action 61 by means of the detector output signal 151.

In various embodiments, both the sensor 50 and the detector 150 are concurrently provided and, accordingly, the pressure member braking action 61 is applied based on any of the sensor 50 sensing the media sheet 30 exiting 30 the fuser nip 14 and the detector 150 detecting an event that occurs prior to the media sheet 30 entering the fuser nip 14.

In various embodiments, the fuser 100 is devoid of both the sensor 50 and the detector 150.

In various embodiments, the pressure member braking action 61 is continuously, always and at all times applied to the pressure member motion 21.

Referring again to FIGS. 2-3, in various embodiments the fuser 100 comprises a fusing member 10 or 90 and a pressure member 20 or 80, where the fusing member and the pressure member cooperatively rotate to form a fuser nip 14, the fuser being arranged so that the pressure member speed 21 at all times and always is reduced with respect to the fusing member speed 11, thus forming a reduced pressure member speed 22. In such embodiments the reduced pressure member speed 22 is independent of, not related to and does not depend on the media sheet 30's exiting 39 from the fuser nip 14.

As described above, the reduced pressure member speed 22 stretches or retards the surface of the fusing member 10 or 90 elastomer enough to assist in stripping or peeling the media sheet lead edge 31 from the fusing member 10 or 90.

As described above, the reduced pressure member speed 22 is based on a pressure member braking action 61 provided by an included braking means 60.

In various embodiments, the pressure member braking action 61 is increased or positively pulsed at one or more fixed time intervals.

In one variation, the pressure member braking action 61 is increased or positively pulsed at one or more fixed time intervals based on detecting the presence of a specifically difficult-to-strip media 30 in the fuser nip 14 by the detector 150. As a result, based on detecting that the specifically difficult-to-strip media 30 is present in the fuser nip 14, the detector 150 causes the braking means 60 at a predetermined time to increase or positively pulse the pressure member braking action 61 at one or more fixed time intervals by means of the detector output signal 151.

In various embodiments, the pressure member braking action 61 is increased or positively pulsed at one or more fixed time intervals based on a predetermined event that occurs prior to and before the media sheet 30 enters the fuser nip 14.

In various embodiments, the pressure member braking action 61 is increased or positively pulsed at one or more fixed time intervals based on a predetermined event that occurs prior to and before the media sheet 30 enters the fuser nip 14 and further based on the passage, elapse or running of a predetermined time period.

In one variation, the predetermined event comprises a detecting of a feeding or dispensing of the media sheet 30 in the upstream media path 2 by the depicted included detector 150. As a result, based on detecting the media sheet 30 being fed or dispensed in the upstream media path 2, the detector 150 causes the braking means 60 at a predetermined time to increase or positively pulse at one or more fixed time intervals the pressure member braking action 61 by means of the detector output signal 151.

In a further variation, the predetermined event comprises a detecting of the presence of the media sheet 30 at a fixed point in the upstream media path by the depicted detector 150. As a result, based on detecting the presence of the media sheet 30 at the fixed point in the upstream media path 2, the detector 150 causes the braking means 60 at a predetermined time to increase or positively pulse at one or more fixed time intervals the pressure member braking action 61 by means of the detector output signal 151.

In various embodiments the pressure member braking action 61 is continuously, always and at all times applied to the pressure member motion 21 and the optional sensor 50 is provided and, accordingly, the pressure member braking action 61 is increased or positively pulsed at one or more fixed time intervals based on the sensor 50 sensing the media sheet 30 exiting 39 the fuser nip 14.

In various embodiments the detector 150 is provided and, accordingly, the pressure member braking action 61 at a predetermined time is increased or positively pulsed at one or more fixed time intervals based on the detector 150 detecting any of (i) the presence of a specifically difficult-to-strip media 30 in the fuser nip 14 (ii) a feeding or dispensing of the media sheet 30 in the upstream media path 2 and (iii) the presence of the media sheet 30 at the fixed point in the upstream media path 2.

In various embodiments, both the sensor 50 and the detector 150 are concurrently provided and, accordingly, the pressure member braking action 61 at a predetermined time is increased or positively pulsed at one or more fixed time intervals based on any of the sensor 50 sensing the media sheet 30 exiting 39 the fuser nip 14 and the detector 150 detecting any of (i) the presence of a specifically difficult-to-strip media 30 in the fuser nip 14 (ii) a feeding or dispensing of the media sheet 30 in the upstream media path 2 and (iii) the presence of the media sheet 30 at the fixed point in the upstream media path 2.

In various embodiments the fuser 100 is devoid of both the sensor 50 and the detector 150.

In various embodiments the fuser 100 pressure member braking action 61 is (i) continuously, always and at all times applied to the pressure member motion 21, thus continuously, always and all times forming a reduced pressure member speed 22, while concurrently and simultaneously (ii) continuously, always and at all times being increased or positively pulsed at one or more fixed time intervals.

In various embodiments the fuser 100 pressure member braking action 61 is (i) continuously, always and at all times applied to the pressure member motion 21, thus continuously, always and at all times forming a reduced pressure member speed 22, while concurrently and simultaneously (ii) devoid of being increased or positively pulsed at one or more fixed time intervals.

Still referring to FIGS. 2-3, in various embodiments the pressure member braking action 61 is generally constant.

Still referring generally to FIGS. 2-3, in one embodiment the paper or media or media stripping process 42 is further assisted by means of an included optional stripping assisting arrangement 70. The stripping assisting arrangement 70, in turn, comprises any of one or more air knives, one or more stripping fingers, or any combination of the foregoing items.

In one embodiment, the stripping assisting arrangement 70 comprises an air knife similar to the air knife 26 as described hereinabove in connection with U.S. Patent Application Publication No. 2005/0156377 by Robert M. Jacobs.

In another embodiment, the stripping assisting arrangement 70 comprises an air knife similar to the air knife 400 as described hereinabove in connection with U.S. Patent Application Publication No. 2003/0039491 by Gregory V. Bogoshian.

In a further embodiment, the stripping assisting arrangement 70 comprises an air knife similar to the air knife 87 and stripping and guide blade 88 as described hereinabove in connection with U.S. Pat. No. 3,716,221 to Donald J. Gorka et al.

In still another embodiment, the stripping assisting arrangement 70 comprises a fuser stripper baffle similar to the fuser stripper baffle 20 as described hereinabove in connection with U.S. Pat. No. 6,963,717 to William R. Klimley et al.

In yet a further embodiment, the stripping assisting arrangement 70 comprises a set of stripper fingers similar to the set of stripper fingers 30 as described hereinabove in connection with U.S. Pat. No. 6,785,503 to Youti Kuo et al.

In yet another embodiment, the stripping assisting arrangement 70 comprises a plurality of stripper finger assemblies similar to the plurality of stripper finger assemblies 40 as described hereinabove in connection with U.S. Pat. No. 6,782,228 to Kenneth R. Rasch et al.

In still a further embodiment, the stripping assisting arrangement 70 comprises a plurality of stripper fingers similar to the plurality of stripper fingers 30 as described hereinabove in connection with U.S. Pat. No. 6,490,428 B1 to Paul M. Fromm et al.

In still another embodiment, the stripping assisting arrangement 70 comprises stripper fingers similar to the stripper fingers 16 as described hereinabove in connection with U.S. Pat. No. 5,822,668 to Paul M. Fromm et al.

In a yet still further embodiment, the stripping assisting arrangement 70 comprises one or more stripper fingers similar to the one or more stripper fingers 104 as described hereinabove in connection with U.S. Pat. No. 5,623,720 to Richard L. Howe et al.

In a yet still another embodiment, the stripping assisting arrangement 70 comprises one or more stripper fingers similar to the one or more stripper fingers 68 as described hereinabove in connection with U.S. Pat. No. 4,042,804 to Rabin Moser.

In yet a further another embodiment, the stripping assisting arrangement 70 comprises stripper fingers similar to any of the plurality of L-shaped stripper fingers 134 and the stripper fingers 142 as described hereinabove in connection with U.S. Pat. No. 3,934,113 to Ari Bar-on.

Figure 4:
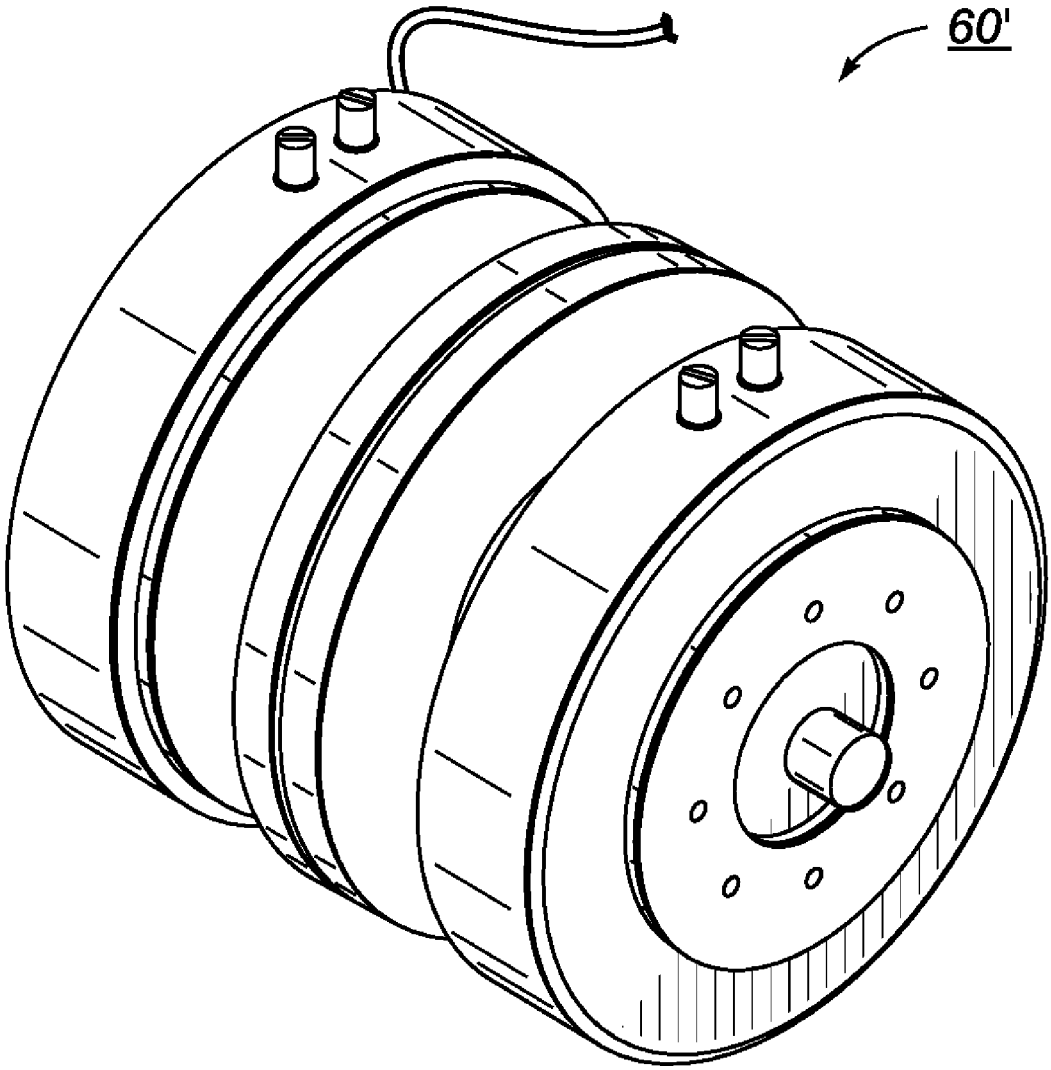
FIG. 4 is an elevated perspective detached view of an electromagnetic brake or clutch embodiment 60' of the pressure member braking means 60 of FIGS. 2 and 3.

Referring now to FIG. 4, in various embodiments the braking means 60 of comprises an electromagnetic brake or clutch similar to the device depicted by reference number 60'. Providing the pressure member braking action 61 by means of an electromagnetic brake or clutch provides the following advantages:

First, an electromagnetic brake or clutch lends itself well to a digital electronic signal; and Second an electromagnetic brake or clutch is comprised of mature technology.

In one embodiment, the magnitude of the pressure member braking action 61 is determined by a required percentage of elastomer elongation, that is to say, the force required to stretch the elastomer at the nip exit from zero to a maximum allowable elastomer stress. The expected percentage of stretch required to properly strip the paper or media or media sheet 30 could range between 0.1% (0.001) and 20% (0.20), yet higher percentages may need to be applied in specific conditions.

In one embodiment, the time duration or period during which the pressure member braking action 61 is applied to the pressure member angular motion or speed 21 is momentary and temporary and is removed when the paper or media or media leading edge 31 becomes satisfactorily severed, peeled-off, separated or stripped from the surface of the fusing member 10. In other words, the pressure member braking action 61 is removed and thereby ceases when it is no longer required.

In one embodiment, the maximum time duration or period during which the pressure member braking action 61 is provided to the pressure member motion 21 is until the paper or media or media sheet trailing edge 32 exits the fuser nip 14.

In one embodiment, the magnitude of the pressure member braking action 61 is constant with time.

In another embodiment, the magnitude of the pressure member braking action 61 varies with time.

Still referring to FIG. 2, in one embodiment the image forming device 200 comprises a printer or printing machine.

Still referring to FIG. 2, in one embodiment the image forming device 200 comprises a copier or copying machine.

Still referring to FIG. 2, in one embodiment the image forming device 200 comprises a fax or facsimile machine.

Moreover, the pressure member, corresponding to reference number 20 in FIG. 2 and reference numbers 20 and 80 in FIG. 3, is arranged with a braking means 60 so that the speed 21 of the pressure member is slowed in relation to the speed 11 of the fusing member depicted by reference number 10 in FIG. 2 and reference numbers 10 and 90 in FIG. 3. This speed difference results in placing a force on the paper or media or media 30 as it exits the fuser nip 14 such that the paper or media or media 30 is pulled 42 from the fusing member.

Thus, there is described a pressure member motion speed reduction device 60 such as, for example, a torque clutch or brake, which slows the pressure member depicted by reference number 20 in FIG. 2 and reference numbers 20 and 80 in FIG. 3, for a short time when the paper or media lead edge 31 exits the fuser nip 14. The resulting reduced pressure member speed 22 stretches or retards the elastomer surface of the fusing member, corresponding to reference number 10 in FIG. 2 and reference numbers 10 and 90 in FIG. 3, enough to assist in peeling 42 the lead edge 31 from the fusing member.

Referring generally to FIGS. 2-3, in various embodiments pressure member braking action 61 as provided by the braking means 60 is initiated, activated, applied or triggered based on one or more of the following techniques. In one embodiment the indication to initiate braking is accomplished by delta time from a previous event. In a first variation of this embodiment, braking is initiated "X" milliseconds after a sheet is successfully fed from the feeder tray, where "X" is to be determined. In a second variation, braking is initiated "Y" milliseconds after a prior or "upstream" paper or media path sensor changes state, where "Y" is to be determined.

Referring still to FIGS. 2-3, in various embodiments the pressure member braking action 61 as provided by the braking means 60 always, constantly and continually brakes, retards and reduces the pressure member's speed 21 a fixed percentage with respect to the fusing member's speed 11, thus accomplishing the intended result by stretching the post nip elastomeric material required to perform the stripping function. In one variation of this constant-braking embodiment, the braking action 61 is pulsed for additional braking, retarding and reduction of the pressure member's speed 21 with respect to the fusing member's speed 11, thereby stretching the elastomer more for specifically difficult media to strip.

Moreover, a fuser arranged for reduced pressure member speed 100 comprises a fusing member 10 or 90 and a pressure member 20 or 80, where the fusing member and the pressure member cooperatively rotate to form a fuser nip 14 therebetween. The fuser is arranged so that the pressure member speed 21 is reduced with respect to the fusing member speed 11, thus forming a reduced pressure member speed 22. The reduced pressure member speed 22 stretches or retards the surface of the fusing member elastomer enough to assist in stripping or peeling 42 the media sheet lead edge 31 from the fusing member 10 or 90. As a result of initially stripping or peeling the media sheet lead edge 31, the remaining media body 30 likewise is assisted to be stripped or peeled from the fusing member. In various embodiments the media stripping or peeling process is assisted by means of one or more air knives 70, one or more stripping fingers, or any combination of these items.

In one embodiment the reduced pressure member speed 22 is based on a pressure member braking action 61 provided by an included braking means 60.

In one embodiment the pressure member speed 21 is reduced with respect to the fusing member speed 11 when the media sheet 30 exits 39 the fuser nip 14.

In one embodiment the indication to initiate the pressure member braking action 61 is accomplished a fixed period of time from a previous predetermined event. For example, in one variation the pressure member braking action 61 is initiated a fixed time period after a media sheet has successfully been fed from the feeder tray. In another variation the pressure member braking action 61 is initiated a fixed time period after a prior paper path sensor changes state.

In various embodiments the pressure member braking action 61 is continuously, always and at all times provided.

In various embodiments the pressure member braking action 61 is continuously, always and at all times provided while concurrently the pressure member braking action 61 additionally is increased or positively pulsed at one or more fixed time intervals.

In various embodiments the pressure member braking action 61 is continuously, always and at all times provided while concurrently, based on any of the following four (4) events respectively labeled (A) through (D): (A) the sensor 50 sensing the media sheet 30 exiting 39 the fuser nip 14; (B) the detector 150 detecting the presence of a specifically difficult-to-strip media 30 in the fuser nip 14; (C) the detector 150 detecting a feeding or dispensing of the media sheet 30 in the upstream media path 2; and (D) the detector 150 detecting the presence of the media sheet 30 at the fixed point in the upstream media path 2; the pressure member braking action 61 additionally is increased or positively pulsed at one or more fixed time intervals.

In various embodiments the pressure member braking action 61 is continuously, always and at all times provided while concurrently the pressure member braking action 61 is devoid of being increased or positively pulsed.

In various embodiments the pressure member braking action 61 is provided based on any of the following four (4) events respectively labeled (A) through (D): (A) the sensor 50 sensing the media sheet 30 exiting 39 the fuser nip 14; (B) the detector 150 detecting the presence of a specifically difficult-to-strip media 30 in the fuser nip 14; (C) the detector 150 detecting a feeding or dispensing of the media sheet 30 in the upstream media path 2; and (D) the detector 150 detecting the presence of the media sheet 30 at the fixed point in the upstream media path 2;

In various embodiments the pressure member braking action 61 is provided based on any of the following four (4) events respectively labeled (A) through (D): (A) the sensor 50 sensing the media sheet 30 exiting 39 the fuser nip 14; (B) the detector 150 detecting the presence of a specifically difficult-to-strip media 30 in the fuser nip 14; (C) the detector 150 detecting a feeding or dispensing of the media sheet 30 in the upstream media path 2; and (D) the detector 150 detecting the presence of the media sheet 30 at the fixed point in the upstream media path 2; while concurrently the pressure member braking action 61 additionally is increased or positively pulsed at one or more fixed time intervals.

In various embodiments the pressure member braking action 61 is provided based on any of the following four (4) events respectively labeled (A) through (D): (A) the sensor 50 sensing the media sheet 30 exiting 39 the fuser nip 14; (B) the detector 150 detecting the presence of a specifically difficult-to-strip media 30 in the fuser nip 14; (C) the detector 150 detecting a feeding or dispensing of the media sheet 30 in the upstream media path 2; and (D) the detector 150 detecting the presence of the media sheet 30 at the fixed point in the upstream media path 2; while concurrently the pressure member braking action 61 additionally is increased or positively pulsed at one or more fixed time intervals based on any of the following further four (4) events respectively labeled (A1) through (D1): (A1) the sensor 50 sensing the media sheet 30 exiting 39 the fuser nip 14; (B1) the detector 150 detecting the presence of a specifically difficult-to-strip media 30 in the fuser nip 14; (C1) the detector 150 detecting a feeding or dispensing of the media sheet 30 in the upstream media path 2; and (D1) the detector 150 detecting the presence of the media sheet 30 at the fixed point in the upstream media path 2.

In various embodiments the pressure member braking action 61 is provided based on any of the following four (4) events respectively labeled (A) through (D): (A) the sensor 50 sensing the media sheet 30 exiting 39 the fuser nip 14; (B) the detector 150 detecting the presence of a specifically difficult-to-strip media 30 in the fuser nip 14; (C) the detector 150 detecting a feeding or dispensing of the media sheet 30 in the upstream media path 2; and (D) the detector 150 detecting the presence of the media sheet 30 at the fixed point in the upstream media path 2; while concurrently the pressure member braking action 61 is devoid of being additionally increased or positively pulsed.

Thus, there is described the first aspect of the invention, substantially as described in claim 1 below, namely, a fuser 100 comprising a fusing member 10 or 90 and a pressure member 20 or 80, where the fusing member and the pressure member cooperatively rotate to form a fuser nip 14 therebetween, the fuser being arranged so that when an included media sheet 30 exits 39 the fuser nip 14 the pressure member speed 21 is reduced with respect to the fusing member speed 11, thus forming a reduced pressure member speed 22.

In one variation, substantially as described in claim 2 below, the reduced pressure member speed 22 is based on a pressure member braking action 61 provided by an included braking means 60.

In another variation, substantially as described in claim 3 below, the pressure member braking action 61 is applied until the media leading edge 31 is stripped 42 from the surface of the fusing member.

In a further variation, substantially as described in claim 4 below, the pressure member braking action 61 is provided 151 based on an event that occurs prior to the media sheet entering the fuser nip 14.

In another variation, substantially as described in claim 5 below, the event comprises a detecting 151 of a feeding or dispensing of the media sheet 30 in the upstream media path 2 by an included detector 150.

In a further variation, substantially as described in claim 6 below, the event comprises a detecting 151 of the presence of the media sheet at a fixed point in the upstream media path 2 by an included detector 150.

In another variation, substantially as described in claim 7 below, the pressure member braking action 61 varies with time.

In a further variation, substantially as described in claim 8 below, the fuser 100 includes means 50 to sense the media sheet exiting 39 the fuser nip 14.

In another variation, substantially as described in claim 9 below, the fusing member comprises any of a fusing roller 10 and a fusing belt 90.

In a further variation, substantially as described in claim 10 below, the pressure member comprises any of a pressure roller 20 and a pressure belt 80.

Also, there has been described the second aspect of the invention, namely, a fuser 100 comprising a fusing member 10, 90 and a pressure member 20, 80, where the fusing member and the pressure member cooperatively rotate to form a fuser nip 14, the fuser being arranged so the pressure member speed 21 is reduced with respect to the fusing member speed 11, thus forming a reduced pressure member speed 22.

In one variation, substantially as described in claim 12 below, the reduced pressure member speed 22 is based on a pressure member braking action 61 provided by an included braking means 60.

In another variation, substantially as described in claim 13 below, the pressure member braking action 61 is increased or positively pulsed at one or more fixed time intervals.

In a further variation, substantially as described in claim 14 below, the pressure member braking action 61 is increased or positively pulsed based on a detecting 151 of the presence of a specifically difficult-to-strip media in the fuser nip 14 by an included detector 150.

In another variation, substantially as described in claim 15 below, the pressure member braking action 61 is increased or positively pulsed based on a detecting 151 of a feeding or dispensing of the media sheet 30 in the upstream media path 2 by an included detector 150.

In a further variation, substantially as described in claim 16 below, the pressure member braking action 61 is increased or positively pulsed based on a detecting 151 of the presence of the media sheet 30 at a predetermined point in the upstream media path 2 by an included detector 150.

In another variation, substantially as described in claim 17 below, the pressure member braking action is generally constant.

In a further variation, substantially as described in claim 18 below, the fuser 100 includes means 50 to sense the media sheet exiting 39 the fuser nip 14.

In another variation, substantially as described in claim 19 below, the fusing member comprises any of a fusing roller 10 and a fusing belt 90, and the pressure member comprises any of a pressure roller 20 and a pressure belt 80.

Also, there has been described the third aspect of the invention, substantially as described in claim 20 below, namely, an image forming device 200 including a fuser 100, the fuser 100 comprising a fusing member 10, 90 and a pressure member 20, 80, where the fusing member and the pressure member cooperatively rotate to form a fuser nip 14 therebetween, the fuser being arranged so the pressure member speed 21 is reduced with respect to the fusing member speed 11, thus forming a reduced pressure member speed 22.

In one variation, the image forming device 200 comprises a printer or printing machine.

In another variation, the image forming device 200 comprises a copier or copying machine.

In a further variation, the image forming device 200 comprises a fax or facsimile machine.

The table below lists the drawing element reference numbers together with their corresponding written description:

REF. NO.: DESCRIPTION

1 downstream media path direction
2 upstream media path direction
10 fusing roller
11 fusing member angular motion or speed
14 fuser nip
15 fusing member outer periphery
20 pressure roller
21 pressure member angular motion or speed
22 reduced pressure member angular motion or speed
25 pressure member outer periphery
30 paper or media sheet
31 paper or media sheet leading edge
32 paper or media sheet trailing edge
39 exiting of paper or media sheet leading edge 31 from fuser nip 14
41 fusing-member-adhering paper path travel direction
42 reduced pressure member speed paper path travel direction
50 sensor
51 sensor output signal
60 braking means
60' electromagnetic brake or clutch
61 pressure member braking action or force
70 optional stripping assisting arrangement
80 pressure belt
90 fusing belt
100 fuser arranged for reduced pressure member speed
150 detector
151 detector output signal
200 image forming device While various embodiments of a fuser arranged for reduced pressure member speed, and an image forming device including the same, in accordance with the present invention, are described above, the scope of the invention is defined by the following claims.

What is claimed is:

1. A fuser comprising a fusing member and a pressure member, where the fusing member and the pressure member cooperatively rotate to form a fuser nip, the fuser being arranged so that when an included media sheet exits the fuser nip the pressure member speed is reduced with respect to the fusing member speed, thus forming a reduced pressure member speed; and further comprising a brake where the reduced pressure member speed is based on a pressure member braking action provided by said brake and where the pressure member braking action is applied until the media leading edge is stripped from the surface of the fusing member.

2. A fuser comprising a fusing member and a pressure member, where the fusing member and the pressure member cooperatively rotate to form a fuser nip, the fuser being arranged so that when an included media sheet exits the fuser nip the pressure member speed is reduced with respect to the fusing member speed, thus forming a reduced pressure member speed; and where the reduced pressure member speed is based on a pressure member braking action provided by an included braking means where the pressure member braking action is applied based on an event that occurs prior to the media sheet entering the fuser nip.

3. The fuser of claim 2, the event comprising a detecting of a feeding or dispensing of the media sheet in the upstream media path by an included detector.

4. The fuser of claim 2, the event comprising a detecting of the presence of the media sheet at a fixed point in the upstream media path by an included detector.

5. The fuser of claim 1 where the pressure member braking action varies with time.

6. The fuser of claim 1 including means to sense the media sheet exiting the fuser nip.

7. The fuser of claim 1 where the fusing member comprises any of a fusing roller and a fusing belt.

8. The fuser of claim 1 where the pressure member comprises any of a pressure roller and a pressure belt.

9. A fuser comprising a fusing member and a pressure member, where the fusing member and the pressure member cooperatively rotate to form a fuser nip, the fuser being arranged so the pressure member speed is reduced with respect to the fusing member speed, thus forming a reduced pressure member speed where the pressure member braking action is increased or positively pulsed at one or more fixed time intervals.

10. The fuser of claim 9 where the reduced pressure member speed is based on a pressure member braking action provided by an included braking means.

11. The fuser of claim 1 where the pressure member braking action is increased or positively pulsed based on a detecting of the presence of a specifically difficult-to strip media in the fuser nip by an included detector.

12. The fuser of claim 1 where the pressure member braking action is increased or positively pulsed based on a detecting of a feeding or dispensing of the media sheet in the upstream media path by an included detector.

13. The fuser of claim 1 where the pressure member braking action is increased or positively pulsed based on a detecting of the presence of the media sheet at a predetermined point in the upstream media path by an included detector.

14. The fuser of claim 10 where the pressure member braking action is generally constant.

15. The fuser of claim 10 including means to sense the media sheet exiting the fuser nip.

16. The fuser of claim 9 where the fusing member comprises any of a fusing roller and a fusing belt and the pressure member comprises any of a pressure roller and a pressure belt.

17. An image forming device including a fuser, the fuser comprising a fusing member and a pressure member, where the fusing member and the pressure member cooperatively rotate to form a fuser nip, the fuser being arranged so the pressure member speed is reduced with respect to the fusing member speed, thus forming a reduced pressure member speed; and further comprising a brake where the reduced pressure member speed is based on a pressure member braking action provided by said brake and where the pressure member braking action is applied until the media leading edge is stripped from the surface of the fusing member.

* * * * *